US007377244B2

(12) United States Patent
Meintschel

(10) Patent No.: US 7,377,244 B2
(45) Date of Patent: May 27, 2008

(54) CAMSHAFT ADJUSTER FOR AN INTERNAL COMBUSTION ENGINE AND A METHOD FOR OPERATING A CAMSHAFT ADJUSTER

(75) Inventor: Jens Meintschel, Esslingen (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 11/598,543

(22) Filed: Nov. 13, 2006

(65) Prior Publication Data

US 2007/0095318 A1 May 3, 2007

Related U.S. Application Data

(63) Continuation-in-part of application No. PCT/EP2005/004626, filed on Apr. 29, 2005.

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 5,161,493 A 11/1992 Ma
5,381,764 A 1/1995 Fukuma et al.
6,328,008 B1 12/2001 Io
6,499,452 B2 12/2002 Ma
6,729,280 B2 * 5/2004 Muraki ..... 123/90.15

FOREIGN PATENT DOCUMENTS

| | | |
|---|---|---|
| DE | 103 24 845 | 1/1924 |
| DE | 41 33 408 | 4/1993 |
| DE | 100 37 942 | 3/2001 |
| DE | 102 47 650 | 4/2003 |
| DE | 102 27 317 | 5/2003 |
| DE | 103 04 439 | 8/2003 |
| DE | 102 24 445 | 12/2003 |
| DE | 103 13 864 | 12/2003 |
| EP | 1 201 886 | 5/2002 |

* cited by examiner

*Primary Examiner*—Zelalem Eshete
(74) *Attorney, Agent, or Firm*—Klaus J. Bach

(57) ABSTRACT

In a camshaft adjuster for an internal combustion engine including a gear mechanism, an input drive element, a camshaft as an output element, and a brake mechanism for braking an adjustment input for the adjustment of a phase position of the camshaft, a coupling mechanism is provided for locking the adjustment mechanism at a particular phase position while the brake mechanism is inactivated.

19 Claims, 3 Drawing Sheets

CAMSHAFT ADJUSTER FOR AN INTERNAL COMBUSTION ENGINE AND A METHOD FOR OPERATING A CAMSHAFT ADJUSTER

This is a Continuation-In-Part application of pending International patent Application PCT/EP2005/004626 filed Apr. 29, 2003 and claiming the priority of German patent application 10 2004 023 548.1 filed 13 May 2004.

BACKGROUND OF THE INVENTION

The invention relates to an adjustment mechanism of a camshaft, to a device for use in an adjustment mechanism and to a method for operating an adjustment mechanism.

In order to change the phase position of a camshaft, hydraulic blade-type adjustors are known, but their adjustment speed and adjustment angle range are small. At low rotational speeds and at a low oil pressure, an adjustment is impossible. Passive electric adjustment mechanisms for camshafts permitting sufficiently high adjustment speeds and large adjustment angles have therefore already been proposed. DE 102 47 650 A1 discloses an electric adjustment mechanism of a camshaft which comprises a brake mechanism, a lever mechanism as the gear mechanism, and an adjustment spring. For the adjustment in a first direction, an adjustment input of the adjustment mechanism is braked. The adjustment in an opposite direction takes place via the adjustment spring. At a constant phase position, the brake mechanism has to operate counter to the adjustment spring, which may cause high brake losses.

It is the object of the present invention to provide a camshaft adjustment mechanism, a device for use in a camshaft adjustment mechanism and a method for operating a crankshaft adjustment mechanism in a simple manner, wherein furthermore there are no brake losses in the camshaft at a constant phase position or they are at least very small.

SUMMARY OF THE INVENTION

In a camshaft adjuster for an internal combustion engine including a gear mechanism, an input drive element, a camshaft as an output element, and a brake mechanism for braking an adjustment input for the adjustment of a phase position of the camshaft, a coupling mechanism is provided for locking the adjustment mechanism at a particular phase position while the brake mechanism is inactivated.

With a coupling mechanism of this type, a coupling torque to be transmitted can be set so as to match requirements, and the coupling can be released within a very short period of time, which is favorable in particular during an adjustment of the phase position when high adjustment dynamics are desired. Furthermore, the wear of the coupling mechanism is advantageously low. The adjustment input is preferably braked for the adjustment in a first direction, for which purpose a preferably contact-free operating, magnetic brake mechanism is provided.

If the coupling mechanism is arranged between the adjustment input and the drive element, an action of a possible adjustment spring, which is preferably arranged between an adjustment input and a drive element and brings about an adjustment of the camshaft in a second direction, can be compensated for if an adjustment in a first direction takes place, for example, by braking of the adjustment input, for example to a rotational speed below the rotational speed of the camshaft. The adjustment spring can also be arranged between adjustment input and output element (camshaft).

The adjustment spring is to be of such a size that its torque, despite a possible low degree of efficiency of the gear mechanism when a self-locking gear mechanism is used, suffices in order to achieve a required adjustment speed when the brake is released. At a constant phase position, the brake would have to be applied to an extent severe enough for the action of the adjustment spring to be compensated for. The coupling mechanism advantageously brings about a spanning of the adjustment spring, so that, at a constant phase position, the brake can even be fully released, at least at low to medium camshaft torques. At high camshaft torques, that occur, for example, during cold starting, the brake and the coupling mechanism can also be operated in parallel in order to keep the phase position constant. The coupling mechanism can expediently be arranged between the adjustment input and the output element (camshaft) if an adjustment spring is arranged between adjustment input and the output element.

In an alternative embodiment, the adjustment spring can be arranged between the drive element and the output element. At a constant phase position, the rotational speed of a sun wheel of a preferred gear mechanism can be brought into line with that of the drive element, in particular a chain wheel, or the camshaft by means of a torque generated in the coupling mechanism. In this case, the brake mechanism does not have to be actuated, for which reason no mechanical brake loss is generated at the camshaft either. This solution is particularly advantageous if additional auxiliary units, such as, for example, a high-pressure pump, a low-pressure pump and the like, are operated via the camshaft.

An adjustment spring may be omitted, with similar advantages, if the gear mechanism is a summing gear mechanism which is designed as a minus summing gear mechanism. Minus summing gear mechanism is to be understood as meaning that, when the drive element is secured, the camshaft rotates in the opposite direction to the adjustment input. A preferred and particularly advantageous embodiment is a single-stage planetary gear mechanism with a chain wheel as the drive element on a planet carrier, a camshaft as the output element on a crown wheel, and an adjustment input on a sun wheel. However, a gear mechanism with a lever mechanism can optionally also be provided, as known, for example, from DE 102 47 650 A1. This may be favorable at small transmission ratios between adjustment input and camshaft and in the event of a small adjustment range, since a self-locking of the gear mechanism can be provided in a particularly simple manner with a lever mechanism.

Particularly small brake losses of the camshaft are possible if the coupling mechanism is arranged in such a manner that, when the coupling mechanism is engaged, the brake mechanism can be fully released at a constant phase position and at least small to medium camshaft torques. The reduction in the brake losses permits savings on consumption of an internal combustion engine, the inlet and/or outlet valves of which are actuated by the camshaft.

In a favorable embodiment of the invention, the gear mechanism is self-locking from the output element in the direction of the adjustment input. Self-locking of this type prevents changing torques to be transmitted from the camshaft to the adjustment input. At sufficiently high transmission ratios of the gear mechanism, a self-locking of the gear mechanism may optionally also be omitted, affording the advantage of an improved degree of efficiency of the gear mechanism. In particular, at sufficiently high transmission ratios of the gear mechanism and with a refinement of the gear mechanism as a minus summing gear mechanism, both a self-locking of the gear mechanism and an adjustment spring may be dispensed with, while, at a constant phase position, the coupling mechanism preferably provides the retaining force for the phase position by itself.

A compact and easily controllable adjustment mechanism can be achieved if a brake element of the brake mechanism forms a coupling element of the coupling mechanism. The brake mechanism, like the coupling mechanism, is preferably a contactlessly operating, magnetic mechanism, and, particularly preferably, the brake mechanism is a hysteresis brake and the coupling mechanism is a hysteresis coupling which both act on a common hysteresis belt.

When the coupling is closed, a force flux can be provided in a simple manner if a support of the coupling element is connected to the adjustment input.

In a preferred embodiment, the coupling element is designed as a ring structure in a stator.

If the stator comprises a stationary stator part and a stator part which is connected in a rotationally fixed manner to the drive element and rotates therewith, a compact hysteresis coupling can be provided. The two stator parts are preferably arranged concentrically.

A device according to the invention for use in an adjustment mechanism has a contact-free operating, magnetic brake mechanism which is connected fixedly to a contactlessly operating, magnetic clutch mechanism. A common ring is preferably provided which rotates in an air gap of the brake mechanism and in an air gap of the clutch mechanism and, on the one hand, can cause braking forces and, on the other hand, coupling forces. The device is compact and is virtually free from wear. The device furthermore permits rapid release of the clutch in order to initiate operations for adjusting the phase position, an adjustable coupling torque at the clutch and brake torque at the brake, and also rapid braking.

The method according to the invention for operating an adjustment mechanism of a camshaft for the adjustment of a phase position of the camshaft makes provision, at a constant phase position, for a rotational speed of an adjustment input of the adjustment mechanism to be matched to a rotational speed of an output element or a drive element by means of a torque flux through a coupling device. A brake loss at the camshaft at a constant phase position is reduced. At small to medium camshaft torques, the brake can be fully released at a constant phase position and the brake losses further minimized.

At high camshaft torques, the brake mechanism and the coupling mechanism can be operated in parallel in order to retain the phase position, with the result that, even under cold starting conditions, in which high camshaft torques occur, reliable functioning of the adjustment mechanism is ensured.

The invention is described in more detail below on the basis of an exemplary embodiment with reference to the accompanying drawings.

DESCRIPTION OF A PARTICULAR EMBODIMENT

In the figures, identical or corresponding elements are descended by the same reference numbers.

Figure 1:
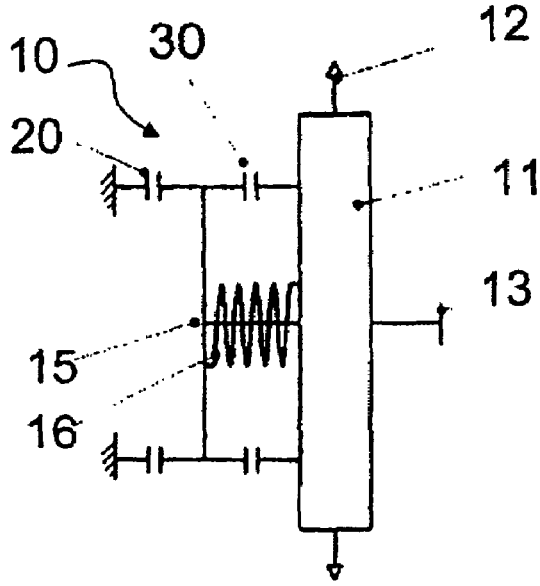
FIG. 1 shows schematically an adjustment mechanism according to the invention with an adjustment spring disposed between the adjustment input and the drive element.
Figure 2:
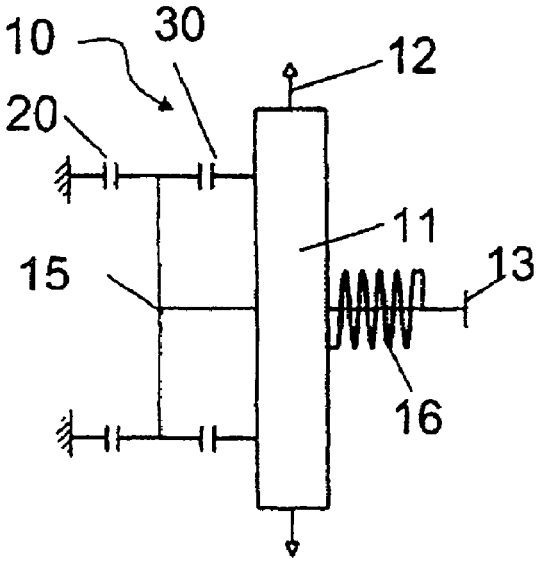
FIG. 2 shows schematically an adjustment mechanism with an adjustment spring disposed between the drive element and output element.
Figure 3:
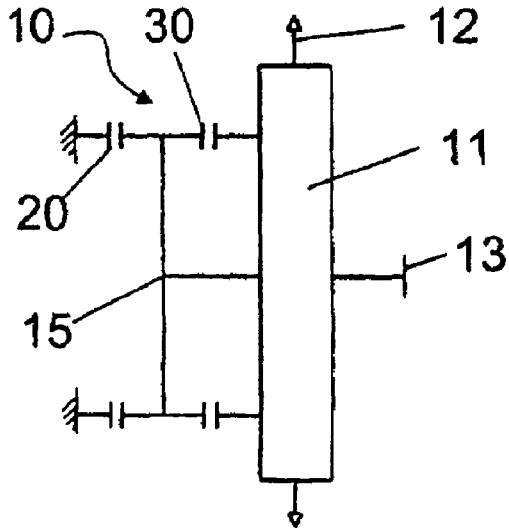
FIG. 3 shows schematically an adjustment mechanism without adjustment spring.

FIGS. 1 to 3 show schematically a camshaft adjustment mechanism 10 according to the invention. The adjustment mechanism 10 in the figures comprises a preferred gear mechanism 11 with drive element 12, for example a chain wheel, which can be driven via a chain (not illustrated) by a crankshaft of an internal combustion engine (not illustrated). An output element 13 is connected to the camshaft.

To simplify the control, the gear mechanism 11 can be self-locking (FIGS. 1 and 2), so that changing torques of the camshaft cannot reach the adjustment input 15. An adjustment of the phase position of the camshaft takes place by the adjustment input 15 being braked by means of a brake mechanism 20 for adjustment in a first direction. An adjustment in a direction opposed to the first direction takes place by means of an adjustment spring 16. FIG. 1 shows the adjustment spring 16 between adjustment input 15 and drive element 12 while FIG. 2 shows the adjustment spring 16 between drive element 12 and output element 13. The action of the adjustment spring 16 can preferably be bridged by means of a clutch mechanism 30 which is arranged between the adjustment input 15 and the drive element 12. The coupling mechanism 30 may optionally be arranged between the adjustment input 15 and the output element 13. It can be prevented thereby that, at a constant phase position, the brake mechanism 20 has to operate against the torque of the adjustment spring 16.

At higher transmission ratios of the gear mechanism, the self-locking may be omitted, which is advantageous for the degree of efficiency of the gear mechanism.

FIG. 3 shows schematically an adjustment mechanism 10 according to the invention without adjustment spring. The adjustment spring may be omitted if the gear mechanism 11 is designed as a minus summing gear mechanism, which is the preferred arrangement.

In the case of the embodiments illustrated in FIGS. 1 to 3, an actuation of the brake mechanism 20 at a constant phase position can be omitted. The rotational speed of the adjustment input 15 is adapted to that of the drive element 12 or the camshaft (output element 13) by means of a torque flux in the coupling device 30. At high camshaft torques, for example during cold starting, the brake mechanism 20 can be operated in parallel with the coupling mechanism 30 at a constant phase position. The maximum torque which can be applied by the brake mechanism 20, which constitutes an important configuration criterion for the brake mechanism 20, is thereby reduced, and the brake mechanism 20 can be configured to be smaller, since the torque is now distributed to coupling mechanism 30 and brake mechanism 20.

Figure 4:
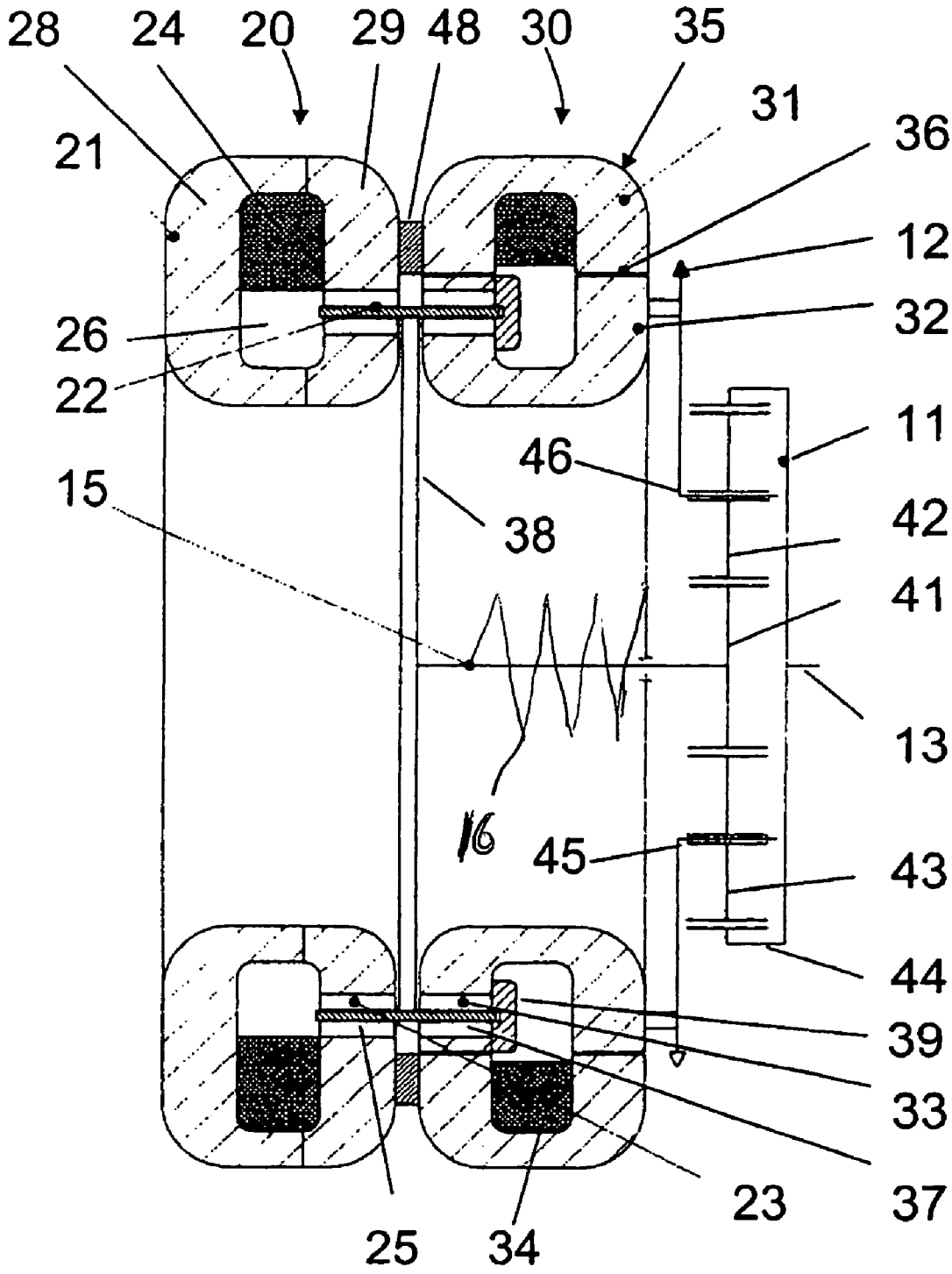
FIG. 4 is a sectional illustration of an adjustment mechanism comprising gear mechanism, brake mechanism and coupling mechanism without illustration of an adjustment spring.

FIG. 4 shows a sectional illustration of an adjustment mechanism 10 comprising a gear mechanism 11, brake mechanism 20 and coupling mechanism 30. An adjustment spring 16 (FIGS. 1, 2) is not illustrated in the figure. The coupling mechanism 30 is preferably a contactlessly operating, magnetic coupling and is arranged in such a manner that, when the coupling mechanism 30 is engaged, the brake mechanism 20 can be fully released at a constant phase position at least at small to medium camshaft torques.

The gear mechanism 11 is preferably designed as a minus summing gear mechanism. A preferred and particularly advantageous embodiment is a single-stage planetary gear mechanism with a chain wheel as the drive element 12 on a planet carrier 45, 46 with planet wheels 42, 43, a camshaft as the output element 13 on a crown wheel 44 and an adjustment input 15 on a sun wheel 41. The planet carriers 45, 46 are provided with bearing bolts for mounting the planet wheels. The planet wheels 42, 43 are in meshing engagement with the sun wheel 41, which is situated in the center, and with the crown wheel 44, which constitutes an outer region of the gear mechanism 11.

A brake mechanism 20 and a coupling mechanism 30 are coupled to form a common device. Both the brake mechanism 20 and the coupling mechanism 30 are designed as contactlessly operating, magnetic elements.

The brake mechanism 20 is in particular a hysteresis brake and has an annular stator 21, in the body of which an excitation coil 24 is arranged in a cavity 26. An air gap 25 of the stator 21 has a pole structure 23 with pole teeth arranged on both sides of the air gap 25 and with which magnetic flux can be coupled into a brake element 22 rotating in the air gap 25. The brake element 22 protrudes with its side facing the brake mechanism 20 into the air gap 25. The air gap 25 opens into the air gap 26. The air gap 25 with the pole structure 23 is arranged on that end surface of the brake mechanism 20 which faces the gear mechanism 11. The brake element 22 is preferably designed as a magnetically semi-hard ring member.

The coupling mechanism 30, which is preferably designed as a hysteresis coupling, adjoins the brake mechanism 20. In this case, the brake element 22 of the brake mechanism 20 at the same time forms a coupling element of the coupling mechanism 30 by the brake element 22, which is a ring member protruding with its side facing the coupling mechanism 30 into an air gap 37 of a stator 35 of the coupling mechanism 30. The air gap 37 is arranged on that end surface of the coupling mechanism 30 which faces away from the gear mechanism 11. The stator 35 is divided into an outer, stationary stator part 31 and an inner stator part 32 which is arranged concentrically thereto and rotates together with the drive element 12. Stator part 31 and stator part 32 are separated by a narrow air gap 36. The air gap 36 is closed on its side facing the gear mechanism 11 by a bridge 39, preferably made from magnetically nonconductive material. The stator 21 of the brake mechanism 20 is connected to the stationary stator part 31 via a connecting element 48.

A support 38 of the coupling element or brake element 22 is connected to the adjustment input 15 of the gear mechanism 11.

The common ring member rotating in the air gap 25 of the brake mechanism 20 and in the air gap 37 of the coupling mechanism 30 causes the braking torque, when the brake is applied, and the frictional connection of the coupling, when the coupling device 30 is engaged, depending in each case on the location of the coupling device, here, for example, between adjustment input 15 and drive element 12.

In the method according to the invention for operating the adjustment mechanism 10 of a camshaft for the adjustment of the phase position of the camshaft, at a constant phase position, a rotational speed of an adjustment input 15 of the adjustment mechanism 10 is matched to a rotational speed of the output element 13 or the drive element 12 by means of a torque flux through the coupling device 30. When the coupling device 30 is closed, a brake mechanism 20 for braking an adjustment input 15 can be fully opened at a constant phase position at least at small to medium camshaft torques. At high camshaft torques, the brake mechanism 20 and the coupling mechanism 30 can be operated in parallel in order to retain the phase position. When the coupling is disengaged, the phase position can be adjusted.

Figure 5:
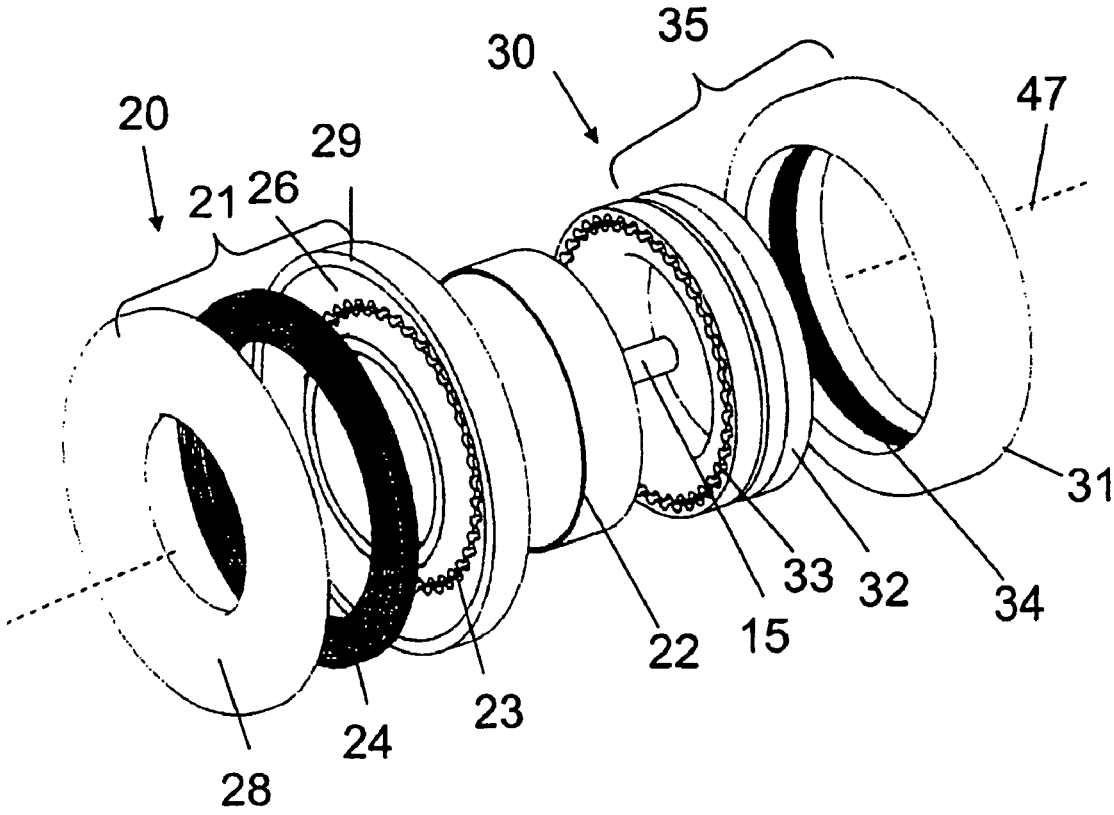
FIG. 5 shows, in an exploded view, a brake mechanism and a coupling mechanism as a detail of an adjustment mechanism without illustration of adjustment spring and adjustment mechanism.

An exploded illustration of brake mechanism 20 and coupling mechanism 30 as a detail of an adjustment mechanism 11 is illustrated in FIG. 5. An adjustment spring and the adjustment mechanism itself are not illustrated. A stator 21 of the brake mechanism 20 is designed as a cup-shaped part 29 which is closed by a covering 28. A cavity 26 in which an annular excitation coil 24 wound coaxially around a center axis 47 can be accommodated is formed in the interior. A pole structure 23 is formed in the bottom of the cup-shaped part 29, the opposite pole teeth of which (a tooth in each case staggered with an opposite gap) are separated by means of a narrow air gap 25 (FIG. 4), with a part of a brake element 22 that faces the stator 21 protruding into the air gap 25. The brake element 22 is connected by its support 38 to an adjustment input 15. The brake element 22 protrudes with its side adjacent a coupling mechanism 30 into an air gap 37 of a stator 35, the air gap 37 separating a pole structure 33 of the stator 35 from the brake element 22. The basic design and the operation of the brake mechanism 20 and of the coupling mechanism 30 are largely identical. Both function as a hysteresis brake or hysteresis coupling. In the assembled state, the brake element 22, which is in the form of a ring, simultaneously extends in the air gap 25 of the pole structure 23 of the brake mechanism 20 and in the air gap 37 of the pole structure 33 of the coupling mechanism 30. Depending on which of the particular excitation coils 24, 34 is energized, the brake element 22 is active as a brake or as a coupling. If appropriate, at high camshaft torques, as may occur during cold starting, both excitation coils 24, 34 may be energized, so that brake mechanism 20 and coupling mechanism 30 are operated in parallel. The strength of the brake mechanism 20 or the strength of the coupling mechanism 30 can be set as a function of the strength of the particular electric excitation current.

In a different manner to the stator 21 of the brake mechanism 20, the stator 35 comprises two coaxial parts, an outer, stationary stator part 31 which surrounds an inner, rotating stator part 32. The stator part 32 rotates together with the drive element 12. The pole structure 33 of the stator 35 is situated in an end surface of the rotating stator part 32, which end surface faces away from the gear mechanism (not illustrated). In the stationary stator part 31, an excitation coil 34 which is wound coaxially around the center axis 47 is arranged in a cavity. The construction is overall compact and robust.

What is claimed is:

1. A camshaft adjuster including a gear mechanism (11), a drive element (12) connected to the gear mechanism (11) for driving a camshaft, an output element (13) connected to the gear mechanism (11) for driving a camshaft of an internal combustion engine, an adjustment input (15) connected to the gear mechanism for controlling the phase position of the output element (13) relative to the drive element (12), and a brake mechanism (20) for braking the adjustment input (15) of the gear mechanism (11) for the adjustment of a phase position of the output element (13) connected to the camshaft at least in a first direction, and a contactlessly operating electromagnetic coupling mechanism (30) disposed between the drive element (12) and the adjustment input (15) for locking the adjustment mechanism in a particular phase relationship.

2. The adjustment mechanism as claimed in claim 1, wherein the coupling mechanism (30) is arranged between the adjustment input (15) and the drive element (12).

3. The adjustment mechanism as claimed in claim 1, wherein the coupling mechanism (30) is arranged between the adjustment input (15) and the output element (13).

4. The adjustment mechanism as claimed in claim 1, wherein the coupling mechanism (30) is arranged in such a manner that, when the coupling mechanism (30) is engaged, the brake mechanism (20) is fully released so as to maintain a constant phase position of the camshaft relative to the drive element (12) at least for relatively low camshaft torques.

5. The adjustment mechanism as claimed in claim 1, wherein an adjustment spring (16) is provided for the adjustment of the phase position of the camshaft in a second direction.

6. The adjustment mechanism as claimed in claim 5, wherein the adjustment spring (16) is arranged between adjustment input (15) and the drive element (12).

7. The adjustment mechanism as claimed in claim 5, wherein the adjustment spring (16) is arranged between the adjustment input (15) and the output element (13).

8. The adjustment mechanism as claimed in claim 5, wherein the adjustment spring (15) is arranged between the drive element (12) and the output element (13).

9. The adjustment mechanism as claimed in claim 5, wherein the coupling mechanism (30) bridges the adjustment spring (16).

10. The adjustment mechanism as claimed in claim 1, wherein the gear mechanism (11) is in the form of a minus summing gear mechanism.

11. The adjustment mechanism as claimed in claim 1, wherein the gear mechanism (11) is designed to be self-locking from the output element (13) in the direction of the adjustment input (15).

12. The adjustment mechanism as claimed in claim 1, wherein a brake element (22) of the brake mechanism (20) is a coupling element of the coupling mechanism (30).

13. The adjustment mechanism as claimed in claim 12, wherein the coupling element (30) includes a support (38), which is connected to the adjustment input (15).

14. The adjustment mechanism as claimed in claim 12, wherein the brake element (22) is a ring structure rotatably arranged in a staler (35).

15. The adjustment mechanism as claimed in claim 14, wherein the stator (35) comprises a stationary stator part (31) and a rotating stator part (32) which is connected in a rotationally fixed manner to the drive element (12).

16. An adjustment mechanism as claimed in claim 14, wherein the ring structure is arranged in an air gap (25) of the brake mechanism (20) and in an air gap (37) of the coupling mechanism (30).

17. A method for operating a camshaft adjuster including a gear mechanism (11), a drive element (12) connected to the gear mechanism (11) for driving a camshaft, an output element (13) connected to the gear mechanism (11) for driving a camshaft of an internal combustion engine, an adjustment input (15) connected to the gear mechanism for controlling the phase position of the output element (13) relative to the drive element (12), and a brake mechanism (20) for braking the adjustment input (15) of the gear mechanism (11) for the adjustment of a phase position of the output element (13) connected to the camshaft at least in a first direction, and a coupling mechanism (30) disposed between the drive element (12) and the adjustment input (15) for locking the adjustment mechanism in a particular phase relationship, said method comprising the steps of: braking the adjustment input (15) for the adjustment of the phase position in one direction and, at a constant phase position, matching a rotational speed of the adjustment input (15) of the adjustment mechanism (10) to the rotational speed of the output element (13) or of the drive element (12) by means of a torque flux through the coupling device (30).

18. The method as claimed in claim 17, wherein with a frictional connection via the coupling device (30), a brake mechanism (20) for braking an adjustment input (15) is fully opened at a constant phase position at least at relatively small camshaft torques.

19. The method as claimed in claim 17, wherein at high camshaft torques, the brake mechanism (20) and the coupling mechanism (30) are operated in parallel in order to retain a phase position.

* * * * *